US010570663B2

(12) United States Patent
Gosling et al.

(10) Patent No.: US 10,570,663 B2
(45) Date of Patent: Feb. 25, 2020

(54) AUTOMATED RANGE-BASED SENSITIVITY ANALYSIS FOR HYDROCARBON RESERVOIR MODELING

(71) Applicant: Landmark Graphics Corporation, Houston, TX (US)

(72) Inventors: Pete Gosling, Calgary (CA); Ron Vutpakdi, Missouri City, TX (US); Gustavo Urdaneta, Houston, TX (US); Ralph E. Mehl, Richmond, TX (US)

(73) Assignee: LANDMARK GRAPHICS CORPORATION, Houston, TX (US)

( * ) Notice: Subject to any disclaimer, the term of this patent is extended or adjusted under 35 U.S.C. 154(b) by 0 days.

(21) Appl. No.: 14/909,959

(22) PCT Filed: Oct. 3, 2013

(86) PCT No.: PCT/US2013/063246
§ 371 (c)(1),
(2) Date: Feb. 3, 2016

(87) PCT Pub. No.: WO2015/050548
PCT Pub. Date: Apr. 9, 2015

(65) Prior Publication Data
US 2016/0201395 A1 Jul. 14, 2016

(51) Int. Cl.
*E21B 43/00* (2006.01)
*E21B 7/04* (2006.01)
*E21B 41/00* (2006.01)

(52) U.S. Cl.
CPC ..... *E21B 7/04* (2013.01); *E21B 41/0092* (2013.01); *E21B 43/00* (2013.01)

(58) Field of Classification Search
CPC ..... E21B 44/00; E21B 43/00; E21B 43/26; E21B 43/30; G06Q 10/06
See application file for complete search history.

(56) References Cited

U.S. PATENT DOCUMENTS

| | | | | |
|---|---|---|---|---|
| 5,918,217 | A | 6/1999 | Maggioncalda et al. | |
| 5,992,519 | A | 11/1999 | Ramakrishnan et al. | |
| 6,393,290 | B1 | 5/2002 | Ufongene | |
| 7,079,952 | B2 | 7/2006 | Thomas et al. | |
| 7,835,893 | B2 | 11/2010 | Cullick et al. | |
| 8,504,341 | B2 * | 8/2013 | Cullick | E21B 43/00 702/12 |

(Continued)

OTHER PUBLICATIONS

International Search Report and Written Opinion, dated Apr. 21, 2014, 19 pages, United States Patent and Trademark Office.

(Continued)

*Primary Examiner* — Kandasamy Thangavelu

(57) ABSTRACT

Methods, systems, and computer program products for range-based sensitivity analysis in hydrocarbon reservoir modeling are disclosed. A computer-implemented method may include receiving a first numeric range defined as a minimum value and a maximum value for a first input parameter of a computational model, computing a different computational model result for each of a plurality of values in the first numeric range by using each of the values as the first input parameter in different respective computational model calculations, and displaying results of the computational model calculations.

25 Claims, 7 Drawing Sheets

(56) References Cited

U.S. PATENT DOCUMENTS

| | | | | |
|---|---|---|---|---|
| 2002/0129004 | A1 | 9/2002 | Bassett et al. | |
| 2003/0126555 | A1 | 7/2003 | Aggarwal et al. | |
| 2004/0220790 | A1* | 11/2004 | Cullick | G06Q 10/06 703/10 |
| 2007/0016389 | A1* | 1/2007 | Ozgen | E21B 47/00 703/10 |
| 2010/0088078 | A1* | 4/2010 | Geehan | E21B 43/26 703/2 |
| 2010/0217762 | A1 | 8/2010 | Kajio et al. | |
| 2011/0040533 | A1* | 2/2011 | Torrens | E21B 44/00 703/2 |
| 2011/0295510 | A1 | 12/2011 | Gulati | |
| 2012/0103754 | A1 | 5/2012 | Lesswing et al. | |
| 2012/0253770 | A1 | 10/2012 | Stern | |
| 2012/0303342 | A1 | 11/2012 | Hazlett et al. | |
| 2013/0035920 | A1* | 2/2013 | Al-Shammari | E21B 43/12 703/10 |
| 2013/0231901 | A1* | 9/2013 | Lu | E21B 43/30 703/1 |

OTHER PUBLICATIONS

Highcharts JS, Internet Products Page, http://www.highcharts.com/products/highcharts ; Release Date Nov. 2009, 5 pgs.

Russell, Wendy, About.com Presentation Software, Print PowerPoint 2010 Slides, http://presentationsoft.about.com/od/powerpoint2010/ss/100826-Print-Powerpoint-2010-Slides_2.htm., PowerPoint 2010, Office Version 2010, 1 pg.

Office Action issued for Canadian Patent Application 2,923,537, dated Oct. 10, 2019, 3 pages.

* cited by examiner

500B

AUTOMATED RANGE-BASED SENSITIVITY ANALYSIS FOR HYDROCARBON RESERVOIR MODELING

CROSS-REFERENCE TO RELATED APPLICATIONS

This application is a U.S. national stage patent application of International Patent Application No. PCT/US2013/063246, filed on Oct. 3, 2013, the benefit of which is claimed and the disclosure of which is incorporated herein by reference in its entirety.

FIELD OF THE DISCLOSURE

The present disclosure generally relates to the modeling of drilling systems in the oil and gas industries, and more particularly, to performing sensitivity analysis during drilling system modeling. Most specifically, the present disclosure relates to performing range-based sensitivity analysis in engineering systems.

BACKGROUND

Modeling in the oil and gas industry is important to maximizing return on investment. Such modeling includes the modeling of formations, as well as the modeling of drilling and extraction systems used to recover hydrocarbons from formations. One important aspect of any such model is to understand the effects of changes to various model parameters. For example, one might model how a change in drilling mud density might affect the drill string penetration rate. To better understand the effects of different parameters on an engineering system, such as a drill string, engineers often turn to sensitivity analysis.

Sensitivity analysis generally describes the process of determining how the projected outcome of a model will be affected by changing the model's input. Sensitivity analysis can provide important insight into the quality of a model and the reliability of the model's input. Sensitivity analysis is used to better manage risk in a wide variety of disciplines, such as engineering, chemistry, economics, finance and biostatistics.

Performing sensitivity analysis is a time intensive process. Typically, a user first must enter a set of input parameters, compute the results, and freeze a line on a plot corresponding to the input. The user then must change the input, compute a second set of results, and freeze a second line on the plot. The same steps must be repeated for each additional scenario the user wishes to analyze. Further, these steps become increasingly difficult with each additional parameter and value used in the analysis.

For example, well planning models are used to plan the drilling of wells in the oil and gas industries. Such models may include dozens of input parameters and sophisticated computer graphics that make sensitivity analysis a tedious and time-consuming process.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements. The drawing in which an element first appears is generally indicated by the left-most digit in the corresponding reference number.

DETAILED DESCRIPTION

Figure 1:
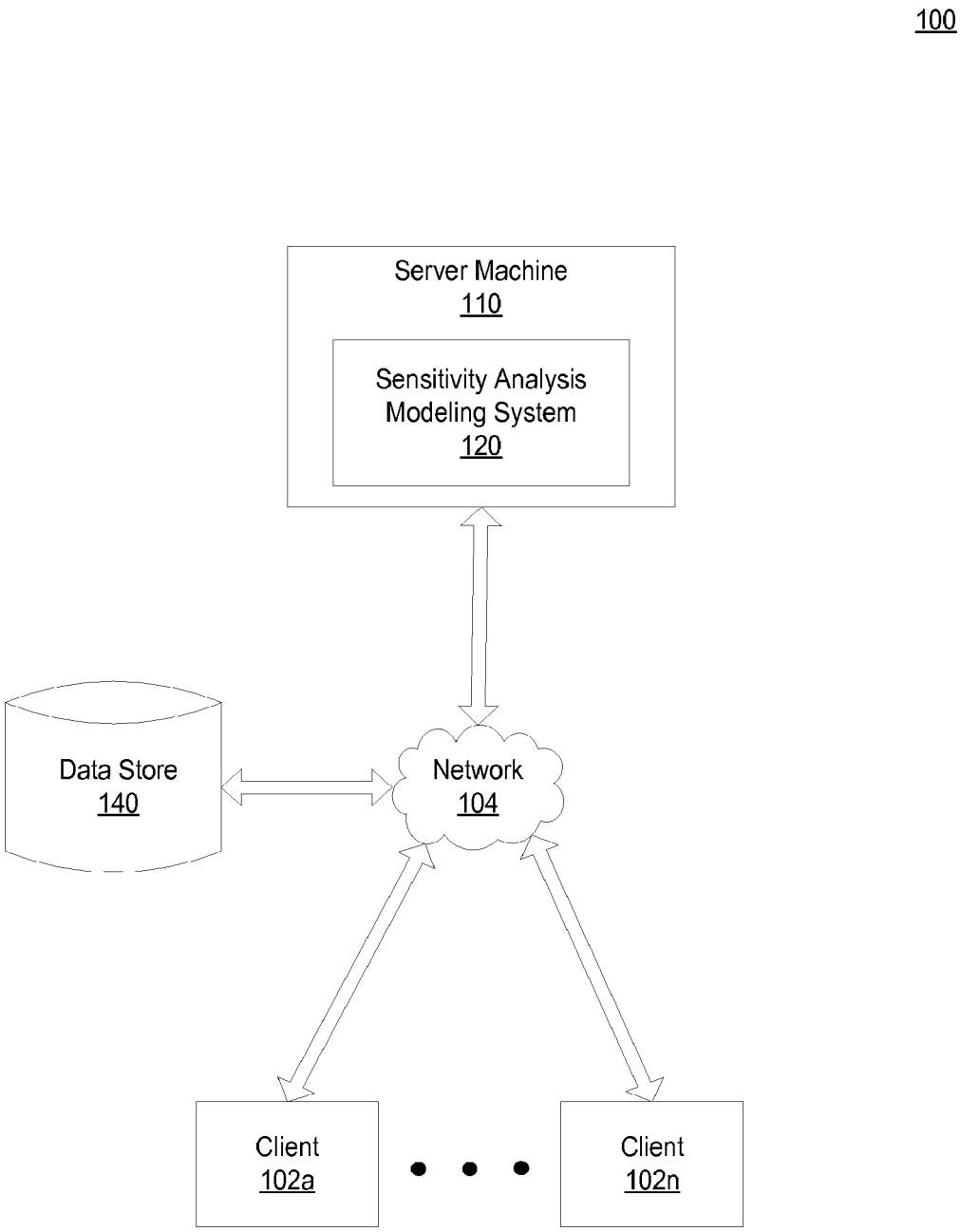
FIG. 1 illustrates a system architecture, in accordance with various embodiments of the present disclosure.

FIG. 1 illustrates system architecture 100 in which embodiments can be implemented. System architecture 100 includes server machine 110, data store 140 and client machines 102A-102N connected to a network 104. Network 104 may be a public network (e.g., the Internet), a private network (e.g., a local area network (LAN), a wide area network (WAN)), or a combination thereof.

Client machines 102A-102N may be personal computers (PC), laptops, mobile phones, tablet computers, or any other computing device. Client machines 102A-102N may run an operating system (OS) that manages hardware and software of the client machines 102A-102N.

Server machine 110 may be a rackmount server, a router computer, a personal computer, a portable digital assistant, a mobile phone, a laptop computer, a tablet computer, a netbook, a desktop computer, a media center, or any combination thereof.

Server machine 110 includes a sensitivity analysis modeling system 120. In some embodiments, sensitivity analysis modeling system 120 may run on one or more different machines. In other embodiments, sensitivity analysis modeling system 120 may run on a single machine.

In general, functions described in embodiments as being performed by server 110 also may be performed on client machines 102A-102N in other embodiments. In addition, the functionality attributed to a particular component can be performed by different or multiple components operating together. Server 110 also can be accessed as a service provided to other systems or devices through appropriate application programming interfaces.

Data store 140 is persistent storage that is capable of storing various types of data (e.g., text, audio, video, images, maps). In some embodiments data store 140 might be a network-attached file server, while in other embodiments data store 140 might be some other type of persistent storage such as an object-oriented database, a relational database, and so forth.

In an example, data store 140 is associated with a well planning service. A well planning service may include systems, software applications and websites that allow users to create, modify, publish, distribute, and access various forms of well planning information. Thus, data store 140 may include well planning data, scenarios, simulations, graphics, etc.

Sensitivity analysis modeling system 120 may perform sensitivity analysis using one or more input parameters having numeric range data specified as input. For example, sensitivity analysis module 120 may assist users by automatically generating sensitivity analysis results based on numeric range data provided for various input parameters of a computational model. Thus, sensitivity analysis modeling system 120 may use numeric range data specified for input parameters to automate various manual and tedious steps that would otherwise be required when performing sensitivity analysis.

For example, sensitivity analysis modeling system 120 may receive a user-provided numeric range for an input parameter, automatically select multiple values from the numeric range to use when performing sensitivity analysis, calculate different computational model results for each of the selected values, generate graphical results to provide sensitivity analysis for the input parameter, and present the graphical results to a user.

In an example, a computational model generally refers to a mathematical model that is used to analyze and predict the behavior of a complex system through computer simulation. Examples of computational models include, but are not limited to, well engineering models, well planning and control models, hydrocarbon reservoir models, weather forecasting models, crime prediction models, etc. Range-based sensitivity analysis may be applied to computational models of any discipline and is not limited to the examples presented in this disclosure.

Figure 2:
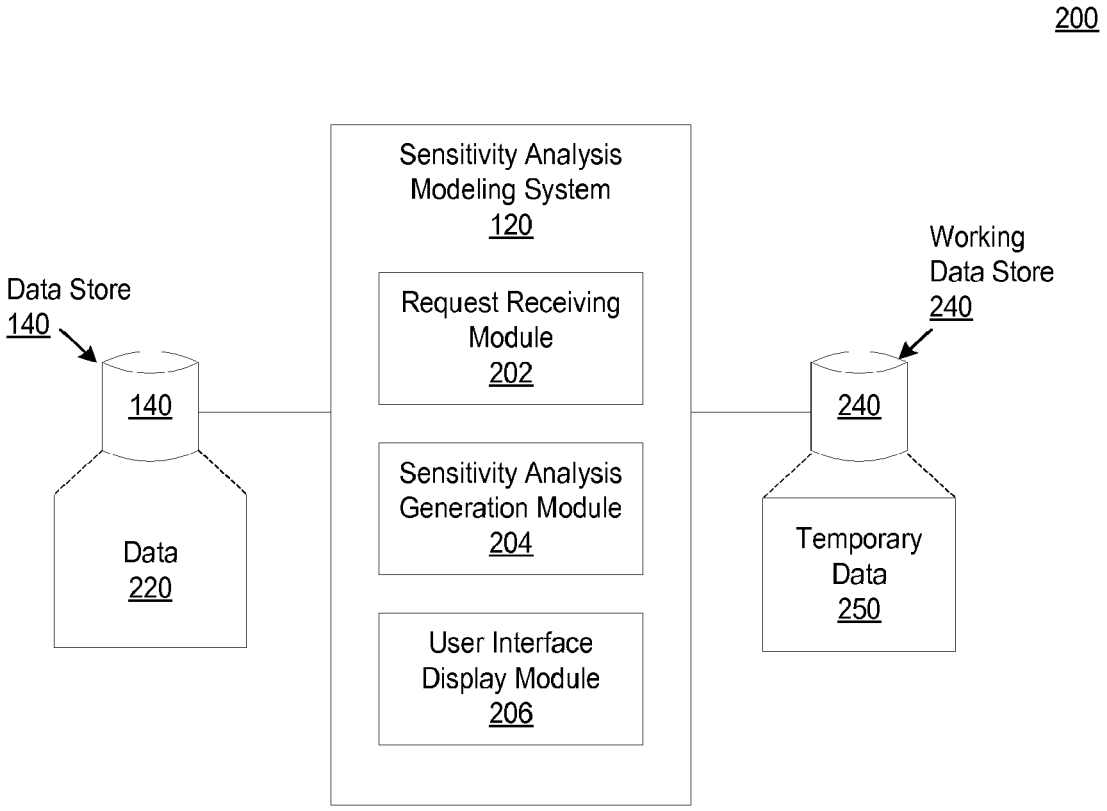
FIG. 2 is a block diagram illustrating a sensitivity analysis modeling system, in accordance with an embodiment.

FIG. 2 is a block diagram illustrating a sensitivity analysis modeling system 120, in accordance with an embodiment. Sensitivity analysis modeling system 120 includes request receiving module 202, sensitivity analysis generation module 204, and user interface display module 206. In other embodiments, functionality associated with one or more of request receiving module 202, sensitivity analysis generation module 204 and user interface display module 206 may be combined, divided and organized in various arrangements. In an embodiment, sensitivity analysis modeling system 120 is coupled to data store 140 and working data store 240. Data store 140 includes data 220. Working data store 240 includes temporary data 250.

In an embodiment, data 220 may include various forms of textual, audio, video, map, geodetic, spatial, and image content used by a sensitivity analysis modeling system 120. For example, with respect to drilling and extraction of hydrocarbons, such data may include formation porosity and permeability, formation pressure, formation stratification, drilling mud weights, drilling mud viscosity, etc. In this regard, data 220 may be data acquired from sensors or other equipment and uniquely associated with a particular reservoir or drilling system, or data 220 may be generally representative of a reservoir or drilling system.

Sensitivity analysis modeling system 120 may use working data store 240 as a temporary storage space for temporary data 250 associated with intermediate calculations and other operations associated with sensitivity analysis modeling system 220. Working data store 240 may include, for example, any type or combination of volatile and non-volatile storage (e.g., disk, memory).

Request receiving module 202 receives values for input parameters of a computational model. Input parameter values may be received as part of a user generated or automated request to perform sensitivity analysis. In one example, a user specifies a numeric range defined as a minimum value and a maximum value for an input parameter of a computational model. The user may specify the numeric range as a single input, for example, in an input field of a graphical user interface or textually on a command line interface. The numeric range then may be submitted as one of many inputs to a computational model. Preferably, the numeric range is provided in a single input field of a graphic user interface.

Sensitivity analysis generation module 204 selects a set of values from a numeric range specified for an input parameter and uses the values to automatically generate sensitivity analysis results. For example, sensitivity analysis generation module 204 uses each of the selected values as input in different computational model calculations to generate the sensitivity analysis results. User interface display module 206 then graphically displays the generated sensitivity analysis results to a user.

Figure 3:
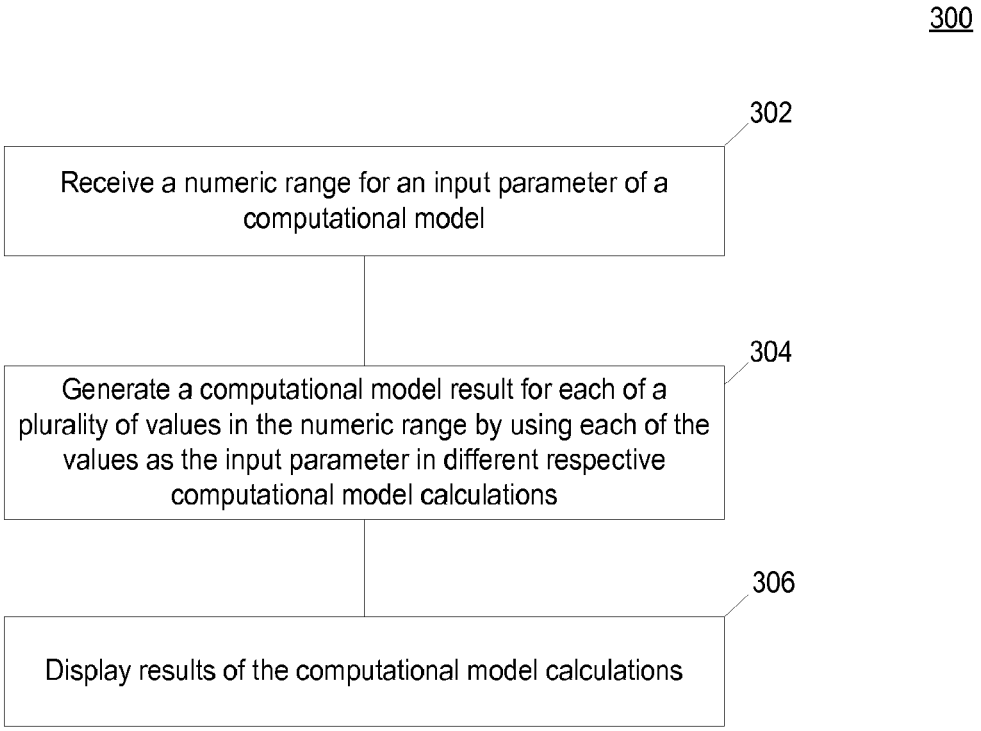
FIG. 3 is a flow diagram illustrating range-based sensitivity analysis modeling, according to an embodiment.

FIG. 3 is a flow diagram illustrating range-based sensitivity analysis modeling, according to an embodiment. Method 300 is performed by processing logic that may comprise hardware (circuitry, dedicated logic, etc.), software (such as is run on a general purpose computer system or a dedicated machine), or a combination of both. In one embodiment, method 300 is performed by server machine 110 of FIG. 1. Method 300 may be performed by sensitivity analysis modeling system 120 running on server machine 110 or one or more other computing devices.

Method 300 begins at stage 302, when a numeric range is received for an input parameter of a computational model. In an embodiment, a computational model includes one or more different input parameters, each of which may accept a single value or a numeric range. In one example, a numeric range is received from an input field in a well planning software application.

In an embodiment, a user enters a numeric range into a "range-aware" input field that accepts a numeric range defined as a minimum and maximum value. For example, a user may enter a numeric range into a range-aware field as a single input using one or more different formats. Valid numeric range formats may include, but are not limited to, min_value–max_value, min_value:max_value, min_value to max_value, min_value/max_value, max_value–min_value, max_value:min_value, max_value to min_value, max_value/min_value, etc. In other words, a range can be represented by a single input.

In an embodiment, one or more range-aware input fields are provided on a user interface. In an example, some range-aware input fields accept only numeric range input. In another example, flexible range-aware input fields may accept one or more different types of input. For example, one type of flexible range-aware input field may accept either a specific numeric value or a defined numeric range at one time. Another type of flexible range-aware input field may accept either a specific text value or a defined numeric range at one time. By accepting a numeric range as a single input (i.e., in a single range-aware field) the portion of the graphical user interface ("GUI") utilized for data input is minimized so as to maximize the GUI for other uses.

In an embodiment, a visual indication may be provided with a range-aware input field. The visual indication may be provided, for example, to notify a user that the corresponding input field can accept a numeric range as input when the input field is empty. In an example, the visual indication may include a distinct color and shape when compared to other related indicators.

In an embodiment, a second visual indication may be provided with a range-aware input field. The second visual indication may be provided, for example, to notify a user that a valid range has been entered into the input field and that the input field is or will be included in computational model calculations. In an example, the visual indication may include a distinct color and shape when compared to other related indicators.

In an embodiment, a third visual indication may be provided with a range-aware input field. The third visual indication may be provided, for example, to notify a user that a valid range has been entered into the input field and that the input field is excluded from current or pending computational model calculations. In an example, the visual indication may include a distinct color and shape when compared to other related indicators.

In an embodiment, a control list comprises information about each range-aware input field that has been populated with range data. The control list may provide details about each respective input field. For example, the control list may display an input field name, a numeric range specified in the input field, and an indication of whether the input field is enabled for inclusion in computational model calculations. In an example, the control list also may provide a selectable option for each of the listed range-aware input fields to allow a user to include or to exclude certain range input when performing sensitivity analysis computations. For example, a user may quickly update sensitivity analysis results by selecting or deselecting one or more range-aware input field listings presented in the control list.

In one example, sensitivity analysis is provided for a range-aware input field populated with range data when the input field is enabled for inclusion in computational model calculations. The sensitivity analysis may be performed using at least two specific values in a numeric range. The specific values may be determined by default (e.g., min, max and midpoint), according to an interval, or based on other criteria.

In another example, a single value from a numeric range is selected for use as a default input parameter in computational model calculations when a user has chosen to exclude range data from a range-aware input field (e.g., the range-aware input field is deselected in the control list, but the input field still contains a numeric range). The single replacement value may be determined by a system setting or user preference (e.g., either a minimum value of the range, a maximum value of the range, or a midpoint of the range). The single replacement value also may be chosen based on a formula, set of rules, or other criteria. In such examples, the single replacement value is used in lieu of the numeric range for computational model calculations. In one example, a user may later include a previously excluded numeric range in subsequent computational model calculations by selecting the corresponding range-aware input field from the control list. Stage 302 may be performed by, for example, request receiving module 202.

At stage 304, a computational model result is generated for each of a plurality of values in the numeric range by using each of the values as an input parameter in different respective computational model calculations. In an embodiment, a plurality of values are selected from a user-provided numeric range provided as a single input in a range-aware input field. The values may be selected from the range to provide automated sensitivity analysis for an input parameter of the computational model. For example, the values may be automatically determined without user involvement by selecting a minimum value, a midpoint, and a maximum value from a defined numeric range. The values also may be determined, for example, according to an interval, function or other method.

In one example, three values from a numeric range are automatically selected to perform sensitivity analysis calculations for a corresponding input parameter of a computational model (e.g., 30, 45 and 60 for the range 30-60). In this example, the computational model is executed three times, each time with a different value selected from the numeric range while other input remains constant. The computational model results then may be provided to a user, for example, in a numerical or graphical format. Stage 304 may be performed by, for example, sensitivity analysis generation module 204.

At stage 306, results of the computational model calculations are displayed. In an embodiment, computational model results are displayed graphically to provide sensitivity analysis for an input parameter entered as a numeric range. For example, the results may be displayed using a two or three dimensional plot, graph, or other visualization. A numerical version of the results also may be provided alone or together with corresponding graphics. In one example, the results may be stored in a database for subsequent access.

In an embodiment, each selected value from a numeric range that is used to generate graphical sensitivity analysis output is provided in a list. In an example, listed values are associated with at least one corresponding portion of the graphical output. In one example, displayed results are adjusted to visually indicate a portion of graphical sensitivity analysis output corresponding to a selected value in the list based on a user interaction with the value. For example, a portion of the graphical results, such as a line or a region, may be highlighted, may change color, or may be shaded when a user clicks, hovers, or interacts with a corresponding value in the list of selected values. Generally, each row in the list of selected values represents a set of numerical values used as parameters when performing a specific computational model calculation. The total number of rows in the list may depend on a number of numerical ranges being utilized and the number of values, intervals or gradations associated with each range.

In another example, a value in the list of selected values is adjusted when a corresponding area of the displayed results is involved in a user interaction. For example, a specific value in the list of selected values may be highlighted, may change color, may be shaded, or may be adjusted (e.g., italicized, underlined, etc.) when a user clicks, hovers, or interacts with a corresponding area of displayed graphical sensitivity analysis output. Stage 306 may be performed by, for example, user interface display module 206.

Figure 4:
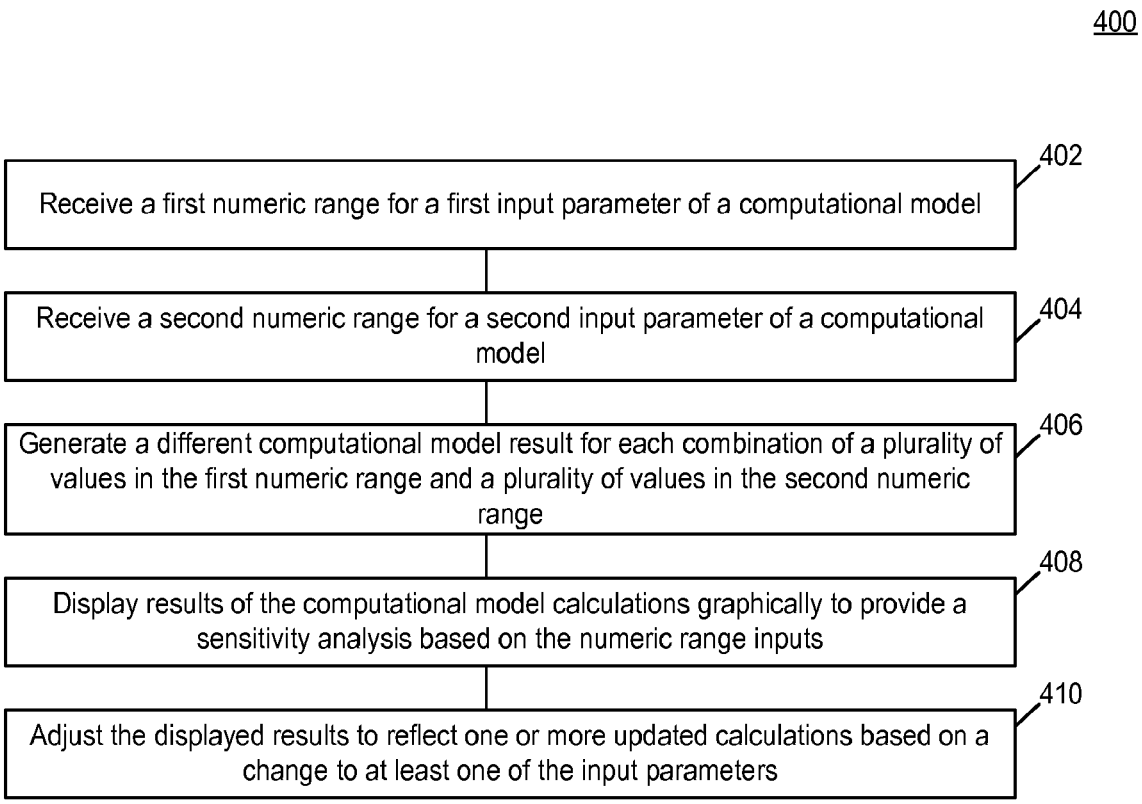
FIG. 4 is a flow diagram illustrating range-based sensitivity analysis modeling using multiple input fields, according to an embodiment.

FIG. 4 is a flow diagram illustrating range-based sensitivity analysis modeling using multiple input fields, according to an embodiment. Method 400 is performed by processing logic that may comprise hardware (circuitry, dedicated logic, etc.), software (such as is run on a general purpose computer system or a dedicated machine), or a combination of both. In one embodiment, method 400 is performed by server machine 110 of FIG. 1. Method 400 may be performed by sensitivity analysis modeling system 120 running on server machine 110 or one or more other computing devices.

At stage 402, a numeric range is received for a first input parameter of a computational model. In an embodiment, a user-provided numeric range is received from a range-aware fluid density input field associated with a computational model for well planning Stage 402 may be performed by, for example, request receiving module 202.

At stage 404, a numeric range is received for a second input parameter of the computational model. In an embodiment, a user-provided numeric range is received from a range-aware plastic viscosity input field associated with a computational model for well planning Stage 404 may be performed by, for example, request receiving module 202.

At stage 406, a different computational model result is generated for each combination of a plurality of values in the first numeric range and a plurality of values in the second numeric range.

In an embodiment, a first set of values is selected automatically from the first numeric range and a second set of values is selected automatically from the second numeric range. For example, a minimum value, a maximum value, and a midpoint (3 values) may be selected automatically from each numeric range (range 1 and range 2). In this non-limiting example, a combination of the selected values results in nine value pairs (e.g., $Max_1Max_2$, $Max_1Mid_2$, $Max_1Min_2$, $Mid_1Max_2$, $Mid_1Mid_2$, $Mid_1Min_2$, $Min_1Max_2$, $Min_1Mid_2$, and $Min_1Min_2$). Each value pair then can be used as input to the computational model to provide sensitivity analysis for corresponding input parameters, for example, while other single value parameters remain constant across computational model calculations.

Selected value combinations may be generated for any two or more numeric ranges. In general, the number of combinations may be determined by multiplying a count of selected values from each numeric range included in computational model calculations.

In an embodiment, each value pair used in computational model calculations may be listed along with associated displayed results. In one example, an area of a sensitivity analysis graph corresponding to a specific value pair may be visually adjusted based on a user interaction involving the value pair in the user interface. A value pair also may be visually adjusted when a user interacts with a corresponding area of the displayed results (i.e., a portion of a sensitivity analysis graph). The visual adjustment may be performed, for example, to assist a user in understanding a relationship between numeric inputs and graphical results. Stage 406 may be performed by, for example, sensitivity analysis generation module 204.

At stage 408, the computational model results are displayed graphically to provide a sensitivity analysis of the computational model based on the numeric range inputs. In an embodiment, computational model calculation results may be displayed using two or three dimensional plots, graphs, diagrams, or other visualizations. A numeric version of the results also may be provided alone or together with the corresponding graphics. Stage 408 may be performed by, for example, user interface display module 206.

At stage 410, the displayed results are adjusted to reflect one or more updated calculations based on a modification to one or more of the input parameters. In one embodiment, displayed computational model results are refreshed to reflect updated computational model calculations performed in response to an event. For example, new sensitivity model calculations may be performed automatically in response to an input field update. Input field updates may include, but are not limited to, modifying a value used in computational model calculations, including one or more previously excluded input values, and excluding one or more previously included input fields. In one example, display results are adjusted automatically in response to an input field update without requiring any further or separate action from a user. Stage 410 may be performed by, for example, user interface display module 206.

Figure 5A:
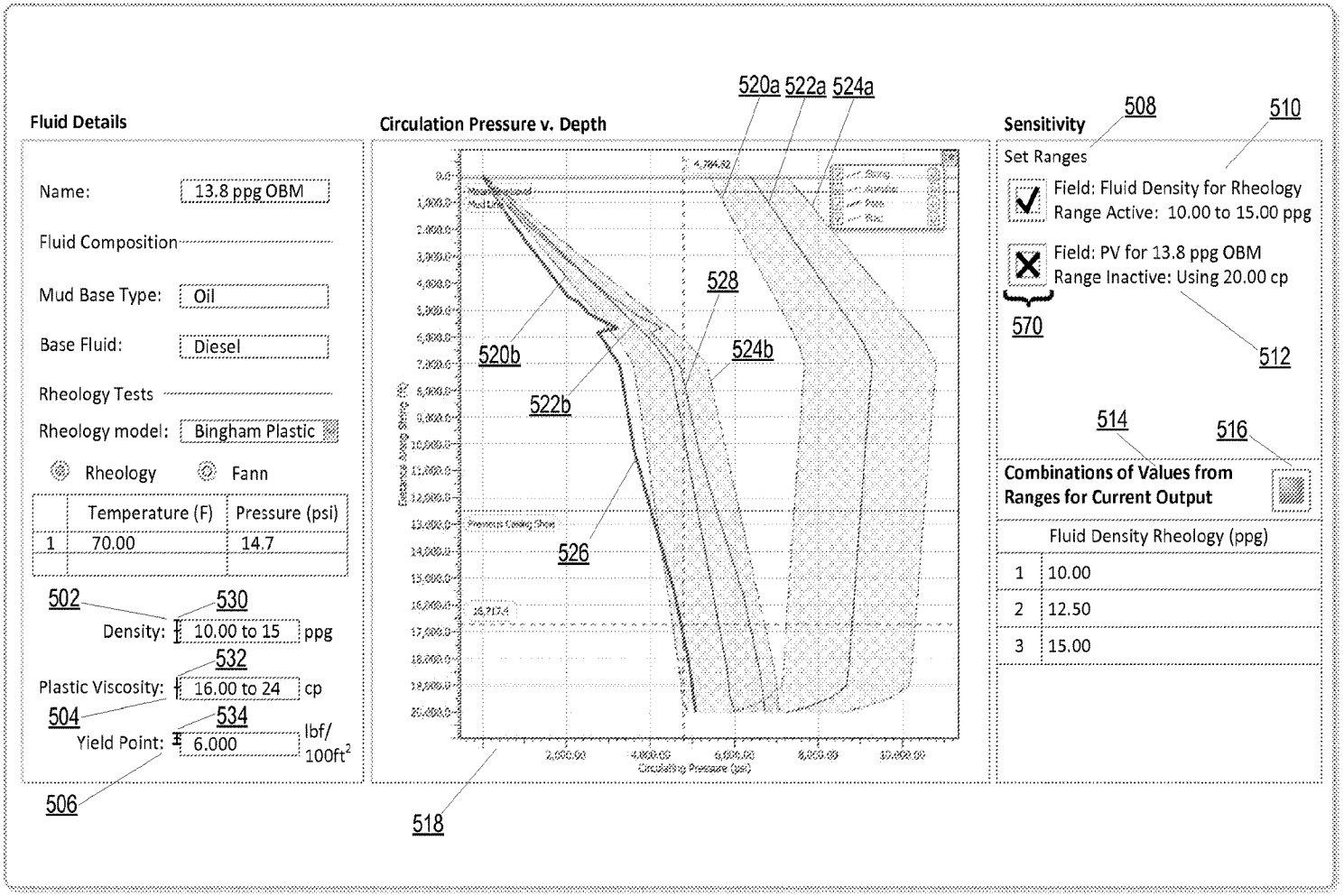
FIG. 5A illustrates a user interface for providing range-based sensitivity analysis in a well planning application, according to an embodiment.

FIG. 5A illustrates a user interface for providing range-based sensitivity analysis in a well planning application, according to an embodiment. User interface 500A includes range-aware input fields 502, 504, 506; a control list 508 for input fields with numeric range input; a list of selected range values 514; a value selection control 516; and a graphical display 518.

Range-aware input fields 502, 504, 506 can accept a numeric range or a single numeric value as input at one time. In the illustrated embodiment, range-aware input fields 502 and 504 are provided with a numerical range while range-aware input field 506 is simply provided with a single numeric value for running the model. More specifically, range-aware input field 502 defines a numeric range for a fluid density input parameter. Range-aware input field 502 also may include an associated visual indication 530 to inform a user that a valid numeric range has been entered and that the input field is currently included in computational model calculations.

Range-aware input field 504 defines a numeric range for plastic viscosity. Range-aware input field 504 also may include an associated visual indication 532 to inform a user that a valid numeric range has been entered and that range values are not currently included in computational model calculations.

Range-aware input field 506 defines a single numeric value for yield point. Range-aware input field 506 also may include a visual indication 534 to inform a user that the input field can accept a numeric range as a single input.

Control list 508 displays listings 510, 512 for each range-aware input field having a numeric range entered as input. Listing 510 provides information about the numeric range defined for fluid density in range-aware input field 502 and indicates that the range is included in calculations (i.e., the check mark), resulting in the list of range values 514.

Listing 512 provides information about the numeric range defined for plastic viscosity in range-aware input field 504 and indicates the range is not included in computational model calculations (i.e., "X"). In this example, rather, a constant value of plastic viscosity (e.g., 20.00 cp) is utilized in each computational model calculation resulting from the list of range values 514. In an example, a user may select a visual indicator 570 (e.g., a check mark, "X", or other indicator) to toggle between including (as active) or excluding (as inactive) a listed range from computational model calculations, which then may automatically recompute calculations and refresh display results accordingly.

The list of range values 514 displays each value within an active range utilized in computational calculations for the model. In the illustrated embodiment, the values of 10.00 ppg (minimum), 12.50 ppg (midpoint), and 15.00 ppg (maximum) are selected automatically from the range of "10 to 15" provided in range-aware input field 502. Although other intervals, gradation, or the like may be defined, it has been found that the maximum, minimum and midpoint across a range yield an instructive graphical representation without sacrificing significant computational time.

In an embodiment, a user may replace a numeric range in range-aware input field 502 by first choosing a value from the list of selected fluid density range values 514 and then selecting value selection control 516. Likewise, in an embodiment, a user may replace a particular value displayed in the range of values 514 to explore the effects on the graphical presentation by first choosing a value from the list of selected fluid density range values 514 and inputting the desired value. In an example, computational model calculations are automatically performed when a user confirms selection of a replacement input value and graphical display 518 is refreshed with updated results.

Graphical display 518 includes sensitivity analysis results 520*a*, 520*b*, 522*a*, 522*b*, 524*a*, 524*b*. In the illustrated embodiment, for each value in the list of selected values 514, a value selected from inactive range 512 is held constant across computational model calculations. In one example, a user interaction involving result 520*a* will cause the value of "10.00" to be highlighted in the list of selected values. In another example, a user interaction involving the value of "15.00" in the list of selected values 514 will cause result 522*a* to be highlighted in graphical display 518.

More specifically, in the illustration, lines 520*a*, 522*a* and 524*a* represent mud column pressure inside the drill string at each of the fluid density values (minimum, midpoint and maximum) selected for investigation from the active range (e.g., the fluid density). Likewise, lines 520*b*, 522*b* and 524*b* represent mud column pressure in the wellbore annulus. With 526 representing pore pressure and 528 representing fracture pressure, it can be seen that only line 522*b*, corresponding to equation calculations utilizing "12.50" from list 514 fall within the pore pressure 526 and fracture pressure 528 boundaries.

Figure 5B:
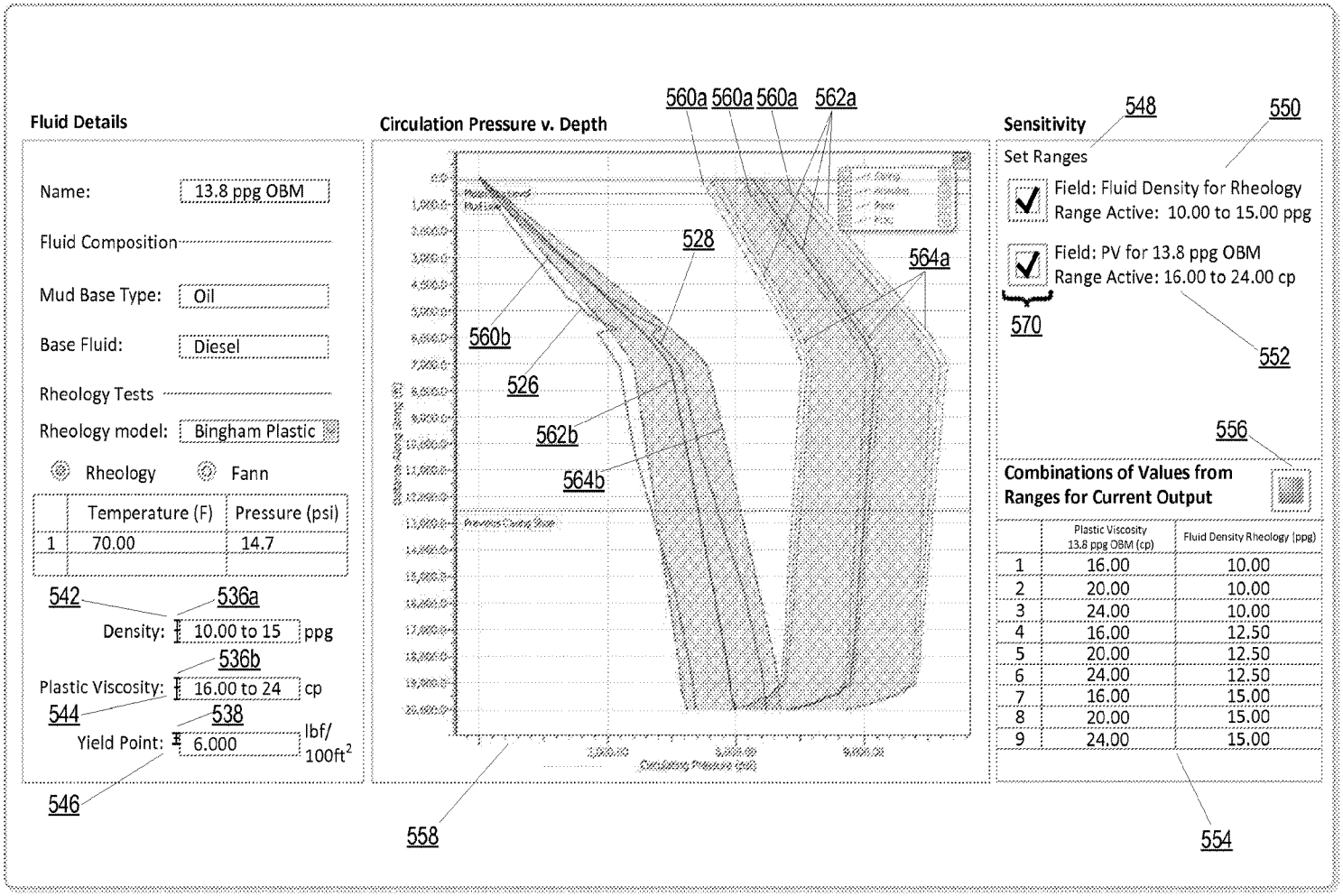
FIG. 5B illustrates a user interface for providing range-based sensitivity analysis on multiple input fields in a well planning application, according to an embodiment.

FIG. 5B illustrates a user interface for providing range-based sensitivity analysis on multiple input fields in a well planning application, according to an embodiment. User interface 500B includes range-aware input fields 542, 544, 546; a control list 548 for input fields with numeric range input; a list of selected value combinations 554; a value selection control 556; and a graphical display 558.

Range-aware input fields 542, 544, 546 each may accept a numeric range or a numeric value as input at one time. In the illustrated embodiment, range-aware input fields 542 and 544 are provided with a numerical range while range-aware input field 546 is simply provided with a single numeric value for running the model. More specifically, range-aware input field 542 defines a first numeric range (i.e., a first sensitivity analysis range) for a fluid density input parameter and indicates via an associated unique symbol 536*a* that the first numeric range is included in computational model calculations. Range-aware input field 544 defines a second numeric range (i.e., a second sensitivity analysis range) for plastic viscosity and indicates via an associated unique symbol 536*b* that the second numeric range also is included in computational model calculations. Range-aware input field 546 defines a single numeric value for yield point and indicates via a different unique symbol 538 that the input field represents a single constant value, as opposed to a range, for the particular analysis.

Control list 548 displays listings 550, 552 for each range-aware input field having a numeric range entered as input (as opposed to a single constant value). Listing 550 provides information about the numeric range defined for fluid density in range-aware input field 542 and indicates at 570 (via a graphical or visual indication, such as the illustrated checkmark) that the range is "active" for purposes of calculations and that multiple values within the range will be used and displayed in the list of range value combinations 554. Listing 552 provides information about the second numeric range defined for plastic viscosity in range-aware input field 544 and indicates (via a graphical or visual indication, such as the illustrated checkmark) the second numeric range also is "active" for purposes of computational model calculations and that multiple values within the range will be used and displayed in the list of range value combinations 554.

The list of value combinations 554 includes each combination of selected values from the first numeric range and selected values from the second numeric range. In an embodiment, each listed combination corresponds to a set of input parameters used in a computational model calculation. Further, each selected value combination in a list of selected value combinations 554 is used as varying input in different computational model calculations to provide sensitivity analysis results.

In an embodiment, a user may replace the first numeric range in range-aware input field 542 and/or the second numeric range in range-aware input field 544 with respective numeric values from a selected value combination. Likewise, in an embodiment, a user may replace a particular value displayed in the range of values 544 to explore the effects on the graphical presentation by first choosing a value from the list of range values 544 and inputting the desired value.

In one example, a user may replace an entire set of range combinations with a specific group of combination values from list 544. The user may first choose the specific combination and then select value selection control 556 to replace numeric ranges with the desired combination. In an example, graphical display 558 is automatically refreshed with updated sensitivity analysis results.

Graphical display 558 includes sensitivity analysis results for the various combinations of range values presented in list 544. In graphical display 558, sensitivity analysis results 560*a*, 560*b*, 562*a*, 562*b*, 564*a*, 564*b* ("the results") are presented and generally refer to multiple (in this case three) computational model results using inputs from the list of selected value combinations 554. For example, sensitivity analysis result 560*a* generally refers to mud column pressure inside the drill string where three different computational model calculations were performed with a constant fluid density of 10.00 ppg and plastic viscosities of 16.00 cp, 20.00 cp and 24.00 cp, respectively. Similarly, sensitivity analysis result 562*a* generally refers to mud column pressure inside the drill string where three different computational model calculations where performed with a constant fluid density of 12.50 ppg and plastic viscosities of 16.00 cp, 20.00 cp and 24.00 cp, respectively. Further, sensitivity analysis result 564*a* generally refers to mud column pressure inside the drill string where three different computational model calculations were performed with a constant fluid density of 15.00 ppg and plastic viscosities of 16.00 cp, 20.00 cp and 24.00 cp, respectively.

Likewise, sensitivity analysis result 560*b*, 562*b* and 564*b* generally refers to mud column pressure in the wellbore annulus for each of the results corresponding to 560*a*, 562*a* and 564*a*. Persons of ordinary skill in the art will appreciate that while three graphical lines are expected for each of the results 560*b*, 562*b* and 564*b*, the changes in 560*b*, 562*b* and 564*b* are so small as to be visually imperceptible on the representation shown in FIG. 5B.

In general, the results indicate that the computational model is much more sensitive to changes in fluid density as compared to changes in plastic viscosity. More specifically, changes to fluid density introduce greater variation, as shown in both the mud column pressure inside and outside the drill string, as compared to changes to plastic viscosity in any of the results.

In an embodiment, sensitivity analysis results 560*a*, 560*b*, 562*a*, 562*b*, 564*a*, 564*b* are associated with corresponding entries in the list of selected values 554. In one example, a user interaction involving a selected value combination in the list of selected values 554 will cause corresponding sensitivity analysis results to be highlighted, and vice versa. Such visual association assists a user in quickly and accurately correlating sensitivity analysis input values with corresponding displayed graphical results.

The foregoing embodiments presented herein are particularly useful when drilling wellbores in oil and gas reservoirs. In an embodiment, an oil or gas reservoir is modeled when designing a well completion plan for a well. In one example, a drilling well completion plan includes selecting a fracturing plan, which may include selecting fracture zones, fracture zone positioning, fracturing fluids, proppants and fracturing pressures. In some embodiments, a drilling well completion plan may include selecting a particular wellbore placement or wellbore trajectory or selecting a desired wellbore pressure to facilitate mass transfer and fluid flow to the wellbore. A drilling plan may be implemented based on a model by preparing equipment to drill the modeled wellbore, and a wellbore may be drilled in accordance with the plan. Thereafter, in one example, fracturing may be carried out in accordance with the model to enhance flow from the reservoir to the wellbore. In another example, wellbore pressure may be adjusted in accordance with the model to achieve a desired degree of mass transfer and fluid flow.

While embodiments of the present disclosure may be described statically as part of implementing a drilling plan, those of ordinary skill in the art will appreciate that such embodiments may also be implemented dynamically. For example, a drilling plan may be implemented using a first set of model data. In addition, actual flow characteristics of a reservoir may be used to update the model for drilling additional wellbores within the reservoir. In another example, the methods, systems and computer program products described herein may be utilized during the drilling process, on the fly or iteratively, to calculate and re-calculate characteristics of the reservoir over a period of time as parameters change, are clarified, or are adjusted. Thus, in an example, results of dynamic calculations may be utilized to alter a previously implemented drilling plan. For example, such dynamic calculations may result in the utilization of heavier or lighter fracturing fluids.

Figure 6:
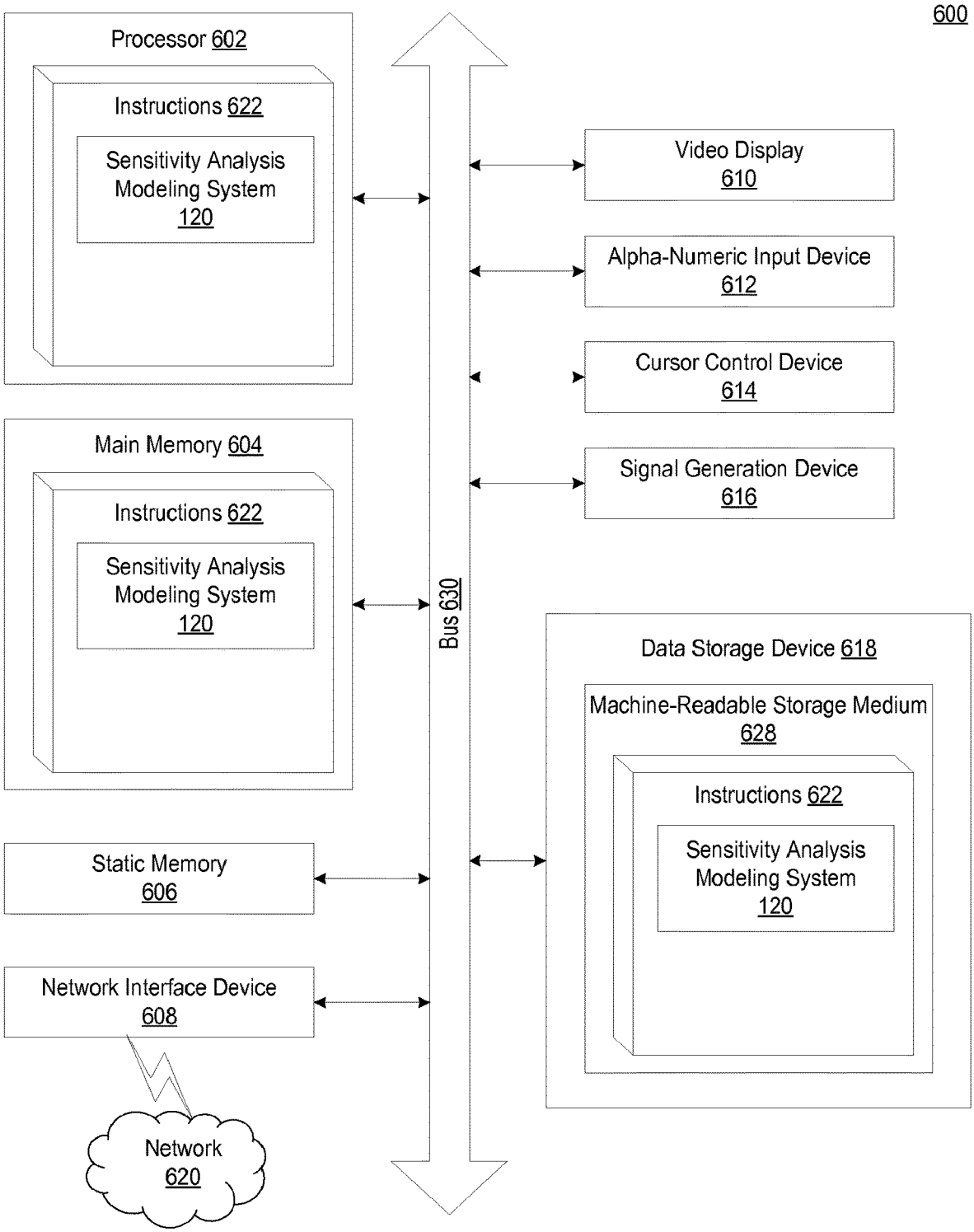
FIG. 6 is a block diagram of an exemplary computer system that may perform one or more of the operations described herein.

FIG. 6 illustrates a diagram of a machine in the exemplary form of a computer system 600 within which a set of instructions, for causing the machine to perform any one or more of the methodologies discussed herein, may be executed. In alternative embodiments, the machine may be connected (e.g., networked) to other machines in a LAN, an intranet, an extranet, or on the Internet. The machine may operate in the capacity of a server or a client machine in client-server network environment, or as a peer machine in a peer-to-peer (or distributed) network environment. The machine may be a personal computer (PC), a tablet PC, a set-top box (STB), a Personal Digital Assistant (PDA), a cellular telephone, a web appliance, a server, a network router, switch or bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The exemplary computer system 600 includes a processing device (processor) 602, a main memory 604 (e.g., read-only memory (ROM), flash memory, dynamic random access memory (DRAM) such as synchronous DRAM (SDRAM), double data rate (DDR SDRAM), or DRAM (RDRAM), etc.), a static memory 606 (e.g., flash memory, static random access memory (SRAM), etc.), and a data storage device 618, which communicate with each other via a bus 630.

Processor 602 represents one or more general-purpose processing devices such as a microprocessor, central processing unit, or the like. More particularly, the processor 602 may be a complex instruction set computing (CISC) microprocessor, reduced instruction set computing (RISC) microprocessor, very long instruction word (VLIW) microprocessor, or a processor implementing other instruction sets or processors implementing a combination of instruction sets. The processor 602 may also be one or more special-purpose processing devices such as an application specific integrated circuit (ASIC), a field programmable gate array (FPGA), a digital signal processor (DSP), network processor, or the like. The processor 602 is configured to execute instructions 622 for performing the operations and steps discussed herein.

The computer system 600 may further include a network interface device 608. The computer system 600 also may include a video display unit 610 (e.g., a liquid crystal display (LCD) or a cathode ray tube (CRT)), an alphanumeric input device 612 (e.g., a keyboard), a cursor control device 614 (e.g., a mouse), and a signal generation device 616 (e.g., a speaker).

The data storage device 618 may include a computer-readable storage medium 628 on which is stored one or more sets of instructions 622 (e.g., software) embodying any one or more of the methodologies or functions described herein. The instructions 622 may also reside, completely or at least partially, within the main memory 604 and/or within the processor 602 during execution thereof by the computer system 600, the main memory 604 and the processor 602, also constituting computer-readable storage media. The instructions 622 may further be transmitted or received over a network 620 via network interface device 608.

In one embodiment, the instructions 622 include instructions for a sensitivity analysis modeling system (e.g., sensitivity analysis modeling system 120 of FIG. 1) and/or a software library containing methods that call a sensitivity analysis modeling system. While the computer-readable storage medium 628 (machine-readable storage medium) is shown in an exemplary embodiment to be a single medium, the term "computer-readable storage medium" should be taken to include a single medium or multiple media (e.g., a centralized or distributed database, and/or associated caches and servers) that store the one or more sets of instructions. The term "computer-readable storage medium" shall also be taken to include any medium that is capable of storing, encoding or carrying a set of instructions for execution by the machine and that cause the machine to perform any one or more of the methodologies of the present disclosure. The term "computer-readable storage medium" shall accordingly be taken to include, but not be limited to, solid-state memories, optical media, and magnetic media.

While a sensitivity analysis system has been described primarily in the context of hydrocarbon reservoir modeling, it will be appreciated by persons of ordinary skill in the art that the sensitivity analysis system may be used for other applications where sensitivity analysis may be desirable or useful.

In the foregoing description, numerous details are set forth. It will be apparent, however, to one of ordinary skill in the art having the benefit of this disclosure, that the present disclosure may be practiced without these specific details. In some instances, well-known structures and devices are shown in block diagram form, rather than in detail, in order to avoid obscuring the present disclosure.

Some portions of the detailed description have been presented in terms of algorithms and symbolic representations of operations on data bits within a computer memory. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "receiving", "computing", "comparing", "displaying", "adjusting," "applying," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Certain embodiments of the present disclosure also relate to an apparatus for performing the operations described herein. This apparatus may be constructed for the intended purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions.

Although various embodiments and methodologies have been shown and described, the present disclosure is not limited to such embodiments and methodologies and will be understood to include all modifications and variations as would be apparent to one skilled in the art. Therefore, it should be understood that this disclosure is not intended to be limited to the particular forms disclosed. Rather, the intention is to cover all modifications, equivalents and alternatives falling within the spirit and scope of the disclosure as defined by the appended claims.

What is claimed is:

1. A computer-implemented method of performing sensitivity analysis for a drilling system, the method comprising:

providing, by a processor via a graphical user interface (GUI), a plurality of input fields corresponding to input parameters of a computational model for performing the sensitivity analysis, the input parameters corresponding to one or more drilling fluids of the drilling system;

automatically generating, by the processor, a set of value pairs for the input parameters of the computational model by selecting, for each value pair in the set, a value from a first numeric range received via a first input field of the GUI for a first of the input parameters and a value from a second numeric range received via a second input field of the GUI for a second of the input parameters;

calculating, by the processor using the computation model, sensitivity analysis results for each value pair in the set of value pairs, each of the value pairs providing a different combination of values of the first and second input parameters selected from the respective first and second numeric ranges as input to the computational model for different computational model calculations;

displaying, by the processor via the GUI, a sensitivity analysis graph including a graphical representation of the sensitivity analysis results of the computational model calculations for each value pair in a corresponding portion of the sensitivity analysis graph, the displayed sensitivity analysis results including a plurality of wellbore pressures corresponding to the set of value pairs;

receiving, by the processor via the GUI, input from a user selecting a wellbore pressure from among the plurality of wellbore pressures within the displayed sensitivity analysis results; and drilling a first portion of a wellbore within a formation using the one or more drilling fluids of the drilling system with values corresponding to the wellbore pressure selected by the user from the displayed sensitivity analysis results.

2. The computer-implemented method of claim 1, wherein automatically generating comprises:

automatically selecting a first set of values in the first numeric range for the first input parameter of the computational model and a second set of values in the second numeric range for the second input parameter of the computational model; and generating the set of value pairs using different combinations of the first set of values for the first input parameter and the second set of values for the second input parameter.

3. The computer-implemented method of claim 2, wherein each of the first and second sets of values are automatically selected according to an interval specified via the GUI for the respective first and second numeric ranges, and each of the first and second sets of values for the respective first and second input parameters are selected from the group consisting of: a minimum value, a midpoint, and a maximum value in the respective first and second numeric ranges.

4. The computer-implemented method of claim comprising:

displaying the selected values in a list associated with the displayed results, wherein each selected value in the list corresponds to a portion of the displayed results.

5. The computer-implemented method of claim 4, further comprising:

adjusting the displayed results to visually indicate a portion of the displayed results that corresponds to a value in the list of selected values when a user event involves the value.

6. The computer-implemented method of claim 4, further comprising:

adjusting the list of the displayed selected values to visually indicate a value corresponding to a portion of the displayed results when a user event involves the portion of the displayed results.

7. The computer-implemented method of claim 1, further comprising:

acquiring data from sensors of the drilling system as the first portion of the wellbore is drilled within the formation, the data including actual values of the first and second input parameters;

updating the set of value pairs for the first and second input parameters of the computational model, based on the acquired data;

recalculating the sensitivity analysis results based on the different computational model calculations with the updated set of value pairs;

updating the sensitivity analysis graph based on the recalculated sensitivity analysis results for drilling a second portion of the wellbore within the formation.

8. The computer-implemented method of claim 1, wherein the first input field of the GUI can accept input for defining the first numeric range as a minimum value and a maximum value.

9. The computer-implemented method of claim 1, further comprising:

displaying a first visual indication associated with an input field to indicate that the input field can accept a numeric range defined as a minimum value and a maximum value.

10. The computer-implemented method of claim 1, further comprising:

displaying a second visual indication associated with an input field that can accept a numeric range when the input field is available for computational model calculations and a valid numeric range is present in the input field.

11. The computer-implemented method of claim 1, further comprising:

displaying a third visual indication associated with an input field that can accept a numeric range when the input field is excluded from computational model calculations and a valid numeric range is present in the input field.

12. The computer-implemented method of claim 1, wherein each of the first numeric range and the second numeric range is defined as a minimum value and a maximum value for the respective first and second input parameters of the computational model.

13. The computer-implemented method of claim 1, wherein the computing comprises:

calculating a different computational model result for each combination of the plurality of values in the first numeric range and each of a plurality of values in the second numeric range.

14. The computer-implemented method of claim 1, further comprising:

displaying a list of each combination of the plurality of values in the first numeric range and the plurality of values in the second numeric range.

15. The computer-implemented method of claim 2, further comprising:

displaying a list of one or more input fields each having a numeric range entered as a single input, wherein each listed input field is displayed with a corresponding selectable option to allow a user to include the numeric range of the input field as input in the computational model.

16. The computer-implemented method of claim 15, further comprising: adjusting the displayed computational model results to reflect updated computational model calculations performed in response to an event.

17. The computer-implemented method of claim 1, wherein the graphical representation of the sensitivity analysis results for each value pair is a sensitivity analysis plot.

18. A system comprising:

a memory and a processor coupled with the memory to perform any of the methods in claims 1-17.

19. A non-transitory computer readable medium having instructions stored thereon that, when executed by a processor, cause the processor to perform any of the methods in claims 1-17.

20. A computer-implemented method of performing sensitivity analysis for modeling a hydrocarbon recovery system in a formation, the method comprising:

providing, by a processor via a graphical user interface (GUI), a plurality of input fields corresponding to input parameters of a computational model for a drilling system, the input parameters corresponding to one or more drilling fluids for the drilling system;

receiving, by the processor via a first input field provided within the GUI, a first numeric range for a first input parameter of the computational model;

receiving, by the processor via a second input field provided within the GUI, a second numeric range for a second input parameter of the computational model;

automatically generating, by the processor, a set of value pairs including different combinations of values selected from the first numeric range received for the first input parameter and values selected from the second numeric range received for the second input parameter, wherein each value pair in the set includes a value of the first input parameter from the first numeric range and a value of the second input parameter from the second numeric range;

calculating sensitivity analysis results for each value pair in the set of value pairs, each of the value pairs providing a different combination of values of the first and second input parameters selected from the respective first and second numeric ranges as input to the computational model for different computational model calculations;

displaying, by the processor via the GUI, a sensitivity analysis graph including a graphical representation of the sensitivity analysis results of the computational model calculations for each value pair in a corresponding portion of the sensitivity analysis graph, the displayed sensitivity analysis results including a plurality of wellbore pressures corresponding to the set of value pairs;

receiving, by the processor via the GUI, input from a user selecting a wellbore pressure from among the plurality of wellbore pressures within the displayed sensitivity analysis results; and drilling a first portion of a wellbore within a formation using the one or more drilling fluids of the drilling system with values corresponding to the wellbore pressure selected by the user from the displayed sensitivity analysis results.

21. The method of claim 20, wherein selecting a drilling plan further comprises:

selecting a fracturing plan for the first portion of the wellbore to be drilled; and drilling the first portion of the wellbore in accordance with the selected fracturing plan.

22. The method of claim 20, further comprising:

acquiring data from sensors of the drilling system as the first portion of the wellbore is drilled within the formation, the data including actual values of the first and second input parameters;

updating the set of value pairs for the first and second input parameters of the computational model, based on the acquired data;

recalculating the sensitivity analysis results based on the different computational model calculations with the updated set of value pairs;

updating the sensitivity analysis graph based on the recalculated sensitivity analysis results for drilling a second portion of the wellbore within the formation.

23. The method of claim 20, wherein the selected drilling plan includes a mud column pressure in the wellbore.

24. A system comprising:

a memory and a processor coupled with the memory to perform any of the methods in claims 20-23.

25. A non-transitory computer readable medium having instructions stored thereon that, when executed by a processor, cause the processor to perform any of the methods in claims 20-23.

* * * * *